US006168093B1

(12) United States Patent
Greer, Jr. et al.

(10) Patent No.: US 6,168,093 B1
(45) Date of Patent: Jan. 2, 2001

(54) AIRLESS SYSTEM FOR SPRAYING COATING MATERIAL

(75) Inventors: Lester R. Greer, Jr., Bellingham; James A. Tryon, Seattle, both of WA (US)

(73) Assignee: Homax Products, Inc., Bellingham, WA (US)

( * ) Notice: Under 35 U.S.C. 154(b), the term of this patent shall be extended for 0 days.

(21) Appl. No.: 09/231,126

(22) Filed: Dec. 30, 1998

(51) Int. Cl.[7] ..... B05B 9/04

(52) U.S. Cl. ..... 239/332; 239/120; 239/376; 239/379; 239/391; 239/526; 239/596; 239/600

(58) Field of Search ..... 239/104, 120, 239/121, 320, 329, 332, 376, 379, 390, 391, 397, 526, 596, 600, 601

(56) References Cited

U.S. PATENT DOCUMENTS

| | | | | |
|---|---|---|---|---|
| D. 237,796 | | 11/1975 | Wagner . | |
| 1,294,190 | | 2/1919 | Sturcke . | |
| 2,704,690 | * | 3/1955 | Eichenauer | 239/332 X |
| 2,999,646 | | 9/1961 | Wagner . | |
| 3,116,879 | | 1/1964 | Wagner . | |
| 3,236,459 | | 2/1966 | McRitchie . | |
| 3,445,068 | | 5/1969 | Wagner . | |
| 3,680,789 | | 8/1972 | Wagner . | |
| 3,876,154 | | 4/1975 | Griebel . | |
| 3,899,134 | | 8/1975 | Wagner . | |
| 4,036,438 | | 7/1977 | Soderlind et al. . | |
| 4,411,387 | | 10/1983 | Stern et al. . | |
| 4,434,939 | * | 3/1984 | Stankowitz | 239/391 X |
| 4,620,669 | * | 11/1986 | Polk | 239/332 X |
| 4,744,516 | * | 5/1988 | Peterson et al. | 239/332 X |
| 4,955,545 | | 9/1990 | Stern et al. . | |
| 4,961,537 | | 10/1990 | Stern . | |
| 5,069,390 | | 12/1991 | Stern et al. . | |
| 5,188,263 | | 2/1993 | Woods . | |
| 5,188,295 | | 2/1993 | Stern et al. . | |
| 5,310,095 | | 5/1994 | Stern et al. . | |
| 5,341,970 | | 8/1994 | Woods . | |
| 5,409,148 | | 4/1995 | Stern et al. . | |
| 5,415,351 | | 5/1995 | Otto et al. . | |
| 5,443,211 | | 8/1995 | Young et al. . | |
| 5,450,983 | | 9/1995 | Stern et al. . | |
| 5,476,879 | | 12/1995 | Woods et al. . | |
| 5,489,048 | | 2/1996 | Stern et al. . | |
| 5,505,344 | | 4/1996 | Woods . | |
| 5,524,798 | | 6/1996 | Stern et al. . | |
| 5,645,198 | | 7/1997 | Stern et al. . | |
| 5,655,691 | | 8/1997 | Stern et al. . | |
| 5,715,975 | | 2/1998 | Stern et al. . | |
| 5,727,736 | | 3/1998 | Tryon . | |

FOREIGN PATENT DOCUMENTS

| | | | | |
|---|---|---|---|---|
| 634230 | | 8/1936 | (DE) . | |
| 470488 | | 11/1935 | (GB) . | |
| 491396 | | 9/1938 | (GB) . | |
| 494134 | | 8/1939 | (GB) . | |
| 534349 | | 3/1941 | (GB) . | |
| 675664 | * | 7/1952 | (GB) | 239/332 |
| 726455 | | 3/1955 | (GB) . | |

* cited by examiner

*Primary Examiner*—Andres Kashnikow
*Assistant Examiner*—Steven J. Ganey
(74) *Attorney, Agent, or Firm*—Michael R. Schacht; Hughes & Schacht, P.S.

(57) ABSTRACT

An airless sprayer adapted to spray both paint and texture material. The sprayer uses a reciprocating piston that mechanically forces the material to be dispensed out of a charging chamber. The piston is driven by a motor mounted within a motor chamber. A working surface of the piston has a surface area adapted to dispense texture material. The sprayer is gravity fed with an overhead hopper. The sprayer is provided with a detachable overflow member that defines an overflow chamber for capturing texture material that leaks around the piston. This overflow chamber is configured relative to the motor chamber such that material leakage is contained within the overflow chamber and does not reach the motor chamber.

24 Claims, 4 Drawing Sheets

AIRLESS SYSTEM FOR SPRAYING COATING MATERIAL

TECHNICAL FIELD

The present invention relates to applicators for coating materials and, more specifically, to applicators that develop a spray appropriate for depositing coating materials onto a surface to be coated.

BACKGROUND OF THE INVENTION

I. Types of Coating Materials

Coating materials are often applied to a surface for protective and/or for aesthetic purposes. The present invention primarily relates to coating materials such as paint or texture material.

Paint is available in a variety of formulations, but in most cases forms a coating on or near the surface that protects and enhances the appearance of the coated surface. Normally, paint is formulated to form a coating of uniform thickness: if the surface is flat and smooth, the paint will dry in a coat that is also flat and smooth. The term "paint" as used herein thus includes stains, clear polymers, and other coatings that are intended to be applied in a coat of uniform thickness.

Texture material, on the other hand, is not formulated to form a coating of uniform thickness; to the contrary, texture material is sprayed on in liquid form and dries to form a bumpy, irregular surface. The texture material may coat the entire surface or may be applied in discrete splotches on the surface.

When dry, the texture material forms a texture pattern. By varying one or more parameters such as the composition of the texture material and the manner in which the texture material is applied, different texture patterns may be formed. Texture patterns are classified generally as follows: fine; orangepeel; medium splatter; heavy splatter; medium knockdown; and heavy knockdown. Of course, custom texture patterns may be formed, but the foregoing texture patterns are considered industry standards.

In addition, a class of texture materials contains particulates and creates an acoustic or "popcorn" texture pattern that is normally applied to ceilings. The present invention is not specifically related to products that create acoustic texture patterns.

The fine, orangepeel, medium splatter, and heavy splatter texture patterns are obtained simply by spraying texture material onto the surface to be textured. The fine and orangepeel texture patterns are similar to each other, the orangepeel simply being a heavier application of texture material.

The medium and heavy knockdown texture patterns are formed by spraying the texture material onto the surface to be textured and, after a short wait but before the texture material dries completely, working the texture material with a tool to flatten or "knockdown" the peaks of the texture material. In general, the medium knockdown texture pattern is obtained by working the medium splatter texture pattern, and the heavy knockdown texture pattern is obtained by working the heavy splatter texture pattern.

II. Application of Coating Materials

The formulation of the coating material is but one factor that controls the uniformity of the thickness of the applied coat. For both paint and texture material, another important factor is the system used to apply the coating material to the surface to be coated.

For paint, four basic types of applicator systems are known. The first is to apply the paint directly to the surface to be coated using a mechanical applicator such as a brush, roller, sponge, or the like. The second is to package the paint in an aerosol system that allows the paint to be applied in a spray. The third is a pneumatic system in which a stream of pressurized air the carries the paint onto the surface to be coated in a spray. And the fourth is an airless system in which a reciprocating piston acts on the paint to form a spray that carries the paint onto the surface to be coated.

Of these applicator systems, only three are commonly employed to dispense texture material. In some situations texture material is applied using a mechanical means such as a conventional paint roller, but this application method is limited in the varieties of texture patterns that may be applied.

Texture material is thus most commonly applied by (a) mixing the texture material with a stream of pressurized air and (b) using aerosol systems. The common factor between aerosol systems and pressurized air systems is that a pressurized gas carries the texture material onto the surface to be coated in a spray.

In most pressurized air systems, the texture material is stored in a hopper located above a hopper gun defining a mixing chamber. The source of pressurized air is normally an air compressor, hand pump, air tank, or the like. A stream of pressurized air is channeled from the air source to the mixing chamber. The texture material is mixed with the stream of pressurized air in the mixing chamber such that the stream carries the texture material out of the hopper gun in a spray. The manner in which the texture material is mixed with the stream of pressurized air and the size of an outlet orifice through which the texture material passes can both be varied to obtain the different texture patterns described above.

In aerosol systems, the texture material is sealed in a container with a pressurized propellant. The propellant exists in a liquid phase and a gas phase. The container is provided with a valve that, when opened, allows the gaseous-phase propellant to force texture material and liquid-phase propellant out of the container in a stream. The liquid propellant gassifies as it exits the container to help form a stream appropriate for depositing the texture material on the surface to be coated. Different texture patterns are obtained by providing means for varying a cross-sectional area of the outlet opening through which the texture material passes.

Unlike paint, texture material is not commonly dispensed using an airless sprayer. Airless sprayers designed for paint tend to atomize the material being dispensed. Atomization is appropriate for paint, which is applied in a thin, uniform coat, but not for texture material; to the contrary, texture material must be allowed to form discrete droplets or clumps in the spray that are deposited on the surface to form the bumpy, irregular texture pattern.

III. Commercial vs. Non-Commercial Applications

Pressurized air systems using an external air source are highly appropriate for commercial applications as they allow large surface areas to be textured quickly and with consistent results; but these systems are relatively bulky and expensive and thus not highly appropriate for non-professionals or for small surface areas.

The hand pump methods are more cost effective for medium jobs (one room or wall), but are not appropriate for larger jobs and can be somewhat difficult to use.

The aerosol methods are the most appropriate for applying texture material to small areas (texturing over patches), but are not cost effective for larger jobs.

The need thus exists for a cost-effective system for allowing non-professionals easily to apply texture material to large surface areas, such as an entire house interior, but which do not require expensive and complicated equipment such as air compressors and the like. Ideally, such a system would be able to spray a large variety of coating materials, including both paint and texture materials.

PRIOR ART

OBJECTS OF THE INVENTION

From the foregoing, it should be clear that one primary object of the present invention is to provide improved spray texturing devices and methods.

Another more specific object of the present invention is to provide spray texturing devices and methods that obtain a favorable mix of the following characteristics:

- do not require an external source of pressurized air;
- do not require physical exertion such as pumping by hand;
- can be used to apply texture material to large surface areas;
- may easily be used by non-professionals;
- are cost effective;
- produce consistent and aesthetically pleasing texture patterns; and
- comprises simple construction and reduced parts to decrease manufacturing costs.

SUMMARY OF THE INVENTION

These and other objects are obtained by the present invention, which in one preferred form is a trigger actuated hopper gun comprising a main housing assembly, a hopper attached to the main housing assembly, a piston, a return spring, an electrical motor, and an overflow housing.

The main housing assembly defines a spring chamber, a charging chamber, an outlet, and a motor chamber. A head of the piston is disposed within the charging chamber, while a tail of the piston is disposed within the spring chamber. The return spring is also disposed within the spring chamber. The hopper attached to the main housing assembly above the charging chamber such that texture material is fed by gravity into the charging chamber.

The charging chamber is in fluid communication with the outlet but is sealed from the spring chamber. The overflow housing is detachably attached to the main housing below the spring chamber. When so attached, the overflow housing and main housing assembly define an overflow chamber that is in fluid communication with the spring chamber.

In operation, the piston moves between a charge position and an expel position. More specifically, the motor is linked to the piston such that it forces the piston from the charge position to the expel position in discrete pulses. The return spring biases the piston towards the charge position such that, when the motor operates, the piston reciprocates between the charge and expel positions. Reciprocation of the piston causes a working surface on the head of the piston to act on texture material in the charging chamber to force the texture material out of the hopper gun through the outlet.

As the piston reciprocates, a small amount of texture material may leak from the charging chamber into the spring chamber around the piston. The overflow chamber and motor chamber are configured such that gravity causes the texture material leaking into the spring chamber to flow into the overflow chamber rather than the motor chamber. The user may remove the overflow housing to empty it of any texture material contained therein.

Additionally, the working surface of the exemplary piston has a cross-sectional area larger than that of the piston of an airless sprayer optimized for spraying paint. This larger area allows the relatively viscous texture material to be expelled in spray appropriate for obtaining the desired texture pattern.

Further, the outlet is formed by one or more output orifices the number and cross-sectional area of which yield an appropriate spray for obtaining a desired texture pattern. And this orifice is reconfigurable among a plurality of configurations to allow texture material to be deposited in one or more of a plurality of texture patterns.

The placement of the hopper above the charging chamber allows the relatively viscous texture material to flow by gravity into the charging chamber. The flow of texture material into the charging chamber will be assisted by a low pressure zone created as the piston moves from the expel position to the charge position.

Given that the hopper is located above the main housing assembly, the position of the overflow chamber relative to the spring and motor chambers ensures that texture material will leak into the overflow chamber and not the motor chamber. The overflow chamber is thus located such that it (a) ensures that leaking texture materials does not interfere with operation of the motor and (b) provides the user with a visual indication when too much texture material is leaking around the piston and the system may require service.

Additionally, the size of the piston and the configuration of the output orifice are determined such that the hopper gun system will form a spray appropriate for depositing texture material on to a surface to be coated, even though the system does not use compressed gas to form the spray.

A system so constructed does not require an external air source or hand pumping. This system is easy to operate and, because it is electrically powered, may be used without undue discomfort to texture large surface areas. This system further allows all of the industry standard texture patterns to be formed, and allows one or another of these patterns to be selected as desired.

A system constructed in accordance with the present invention can be manufactured inexpensively and reliably and thus is cost effective. This system also yields consistent, repeatable texture patterns of high quality.

DETAILED DESCRIPTION

Figure 1A:
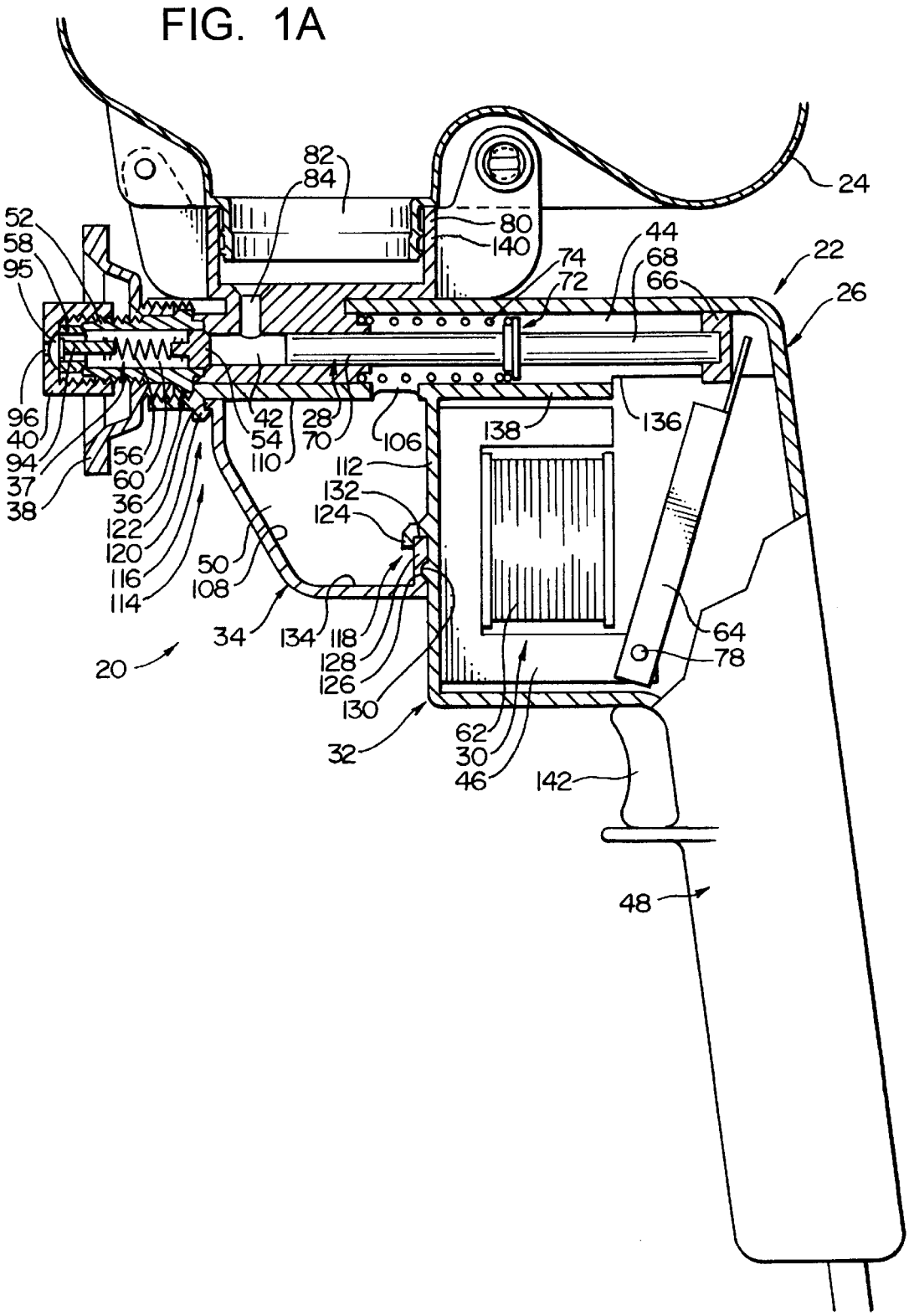
FIGS. 1A and 1B are side, cut-away views depicting a hopper gun spray texturing system constructed in accordance with, and embodying, the principles of the present invention.

Referring now to FIG. 1A, depicted at 20 therein is a texturing system adapted to apply coating materials to a surface (not shown) to be coated. The system 20 comprises a gun assembly 22 and a hopper 24. The gun assembly 22 comprises a main housing assembly 26, a piston 28, and a motor assembly 30.

In use, the hopper 24 is attached to the gun assembly 22 such that material within the hopper 24 flows into the main housing assembly 26. The motor assembly 30 operates the piston 28 to discharge the flowable material in a spray. The flowable material sprayed by the system 20 can be any one of a number of coating materials, but the system 20 is, as will become apparent below, specifically designed to dispense texture materials.

The hopper 24 is or may be conventional; an appropriate hopper is sold by Homax Products, Inc. under part numbers 8322, 4550, and 4505P. This type of hopper is detachable and, in some cases, disposable and contains a predetermined amount of texture material (e.g., 0.58 gal., 0.79 gal., 1.84 gal.). The hopper 24 is not per se part of the present invention and will be discussed herein only to the extent necessary for a complete understanding of the operation of the system 20.

The main housing assembly 26 comprises a main housing 32, an overflow housing member 34, an outlet spring housing assembly 36, a retaining member 38, and a nozzle member 40.

The main housing 32 defines a charging chamber 42, a return spring chamber 44, a motor chamber 46, and a handle portion 48. The overflow housing member 34 is attached to the main housing 32 to define an overflow chamber 50.

A check valve assembly 37 is formed by the outlet spring housing assembly 36, which comprises a valve housing member 52, a check valve member 54, a spring 56, and an outlet member 58. The valve housing member 52 defines an outlet chamber 60.

The retaining member 38 holds the outlet spring housing assembly 36 such that the outlet chamber 60 is adjacent to the charging chamber 42 with the check valve member 54 selectively preventing or allowing fluid communication between the charging chamber 42 and the outlet chamber 60.

The nozzle member 40 is attached to the valve housing member 52 such that it holds the outlet member 58 in place to form the outlet spring assembly 36.

The motor assembly 30 comprises a solenoid assembly 62, a drive member 64, a contact member 66, and a shaft member 68. The piston member 28 comprises a head portion 70 and a tail portion 72. The tail portion 72 has a diameter that is increased relative to that of the head portion 70. The head portion 70 resides partly in the charging chamber 42 and partly in the return spring chamber 44. A return spring 74 is mounted within the return spring chamber 44 between the piston tail 72 and a fixed surface 76 formed on the main housing 26.

Figures 2A, 3, 4, 5, 6:
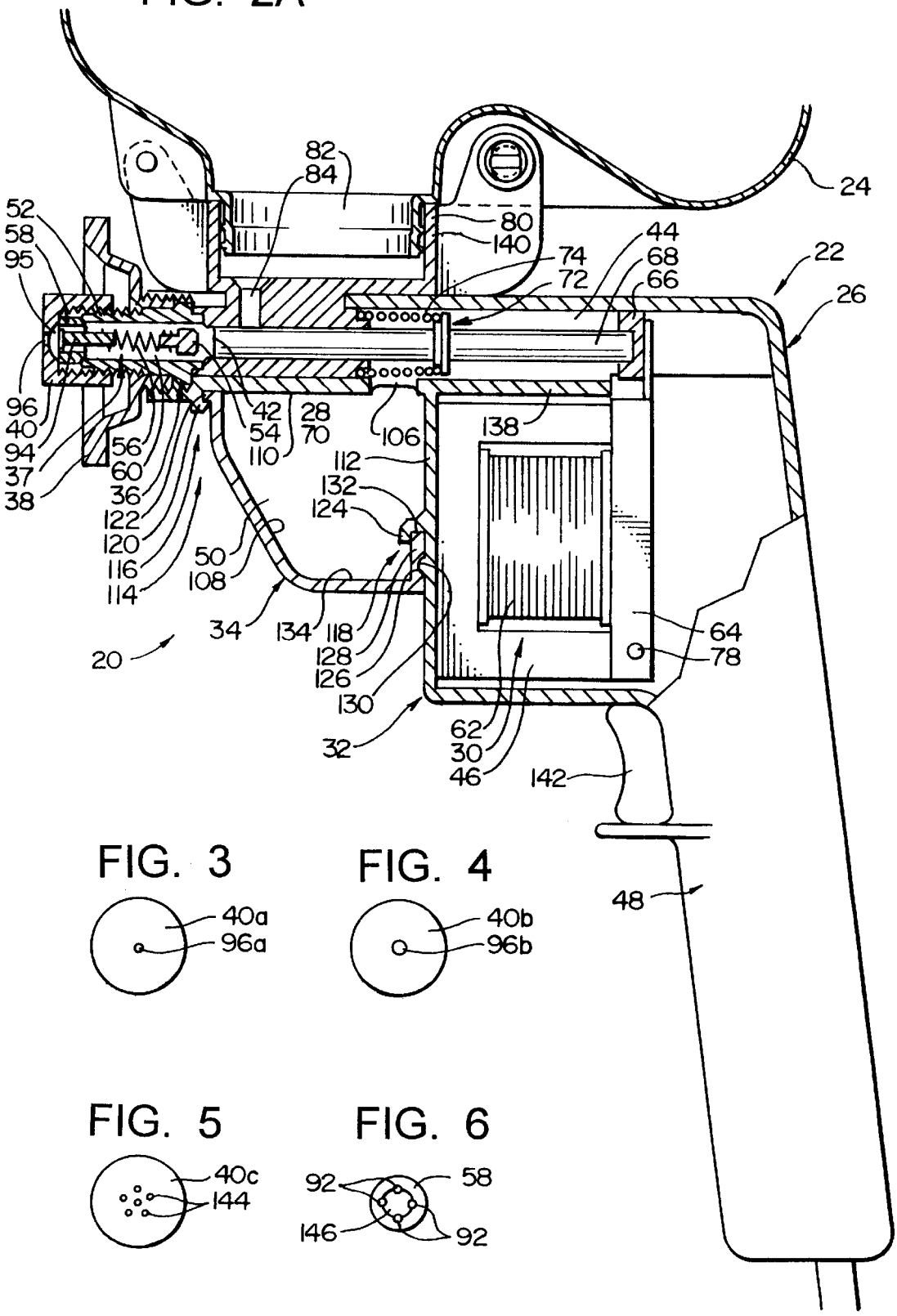
FIGS. 2A and 2B depict the system shown in FIGS. 1A–1B in the process of expelling texture material.
FIG. 3 depicts a front elevational view of a second nozzle member that may be used to form an outlet orifice of a second configuration.
FIG. 4 depicts a front elevational view of a third nozzle member that may be used to form an outlet orifice of a third configuration.
FIG. 5 depicts a front elevational view of a fourth nozzle member that may be used to form an outlet orifice of a fourth configuration.
FIG. 6 is a rear, elevational view of an end plug through which texture material passes as before it exits the system through the outlet orifice.

Energizing the solenoid assembly 62 causes the drive member 64 to rotate about a pivot point 78 (the rotation is shown by a comparison of FIGS. 1A and 2A) such that the shaft 68 is moved along its axis. The shaft 68 is held against the piston tail 72 such that movement of the shaft 68 towards the piston 28 causes the piston 28 to move from a charge position as shown in FIG. 1A to a discharge position as shown in FIG. 2A. This movement of the piston 28 is resisted by the return spring 74 such that, when the solenoid assembly 62 is in a second portion of its cycle, the return spring 74 forces the shaft 68 back to the position shown in FIG. 1A. The solenoid assembly 62 thus operates in a cyclical or pulsed fashion to move the piston 28 between the positions shown in FIGS. 1A and 2A.

Figure 1B:
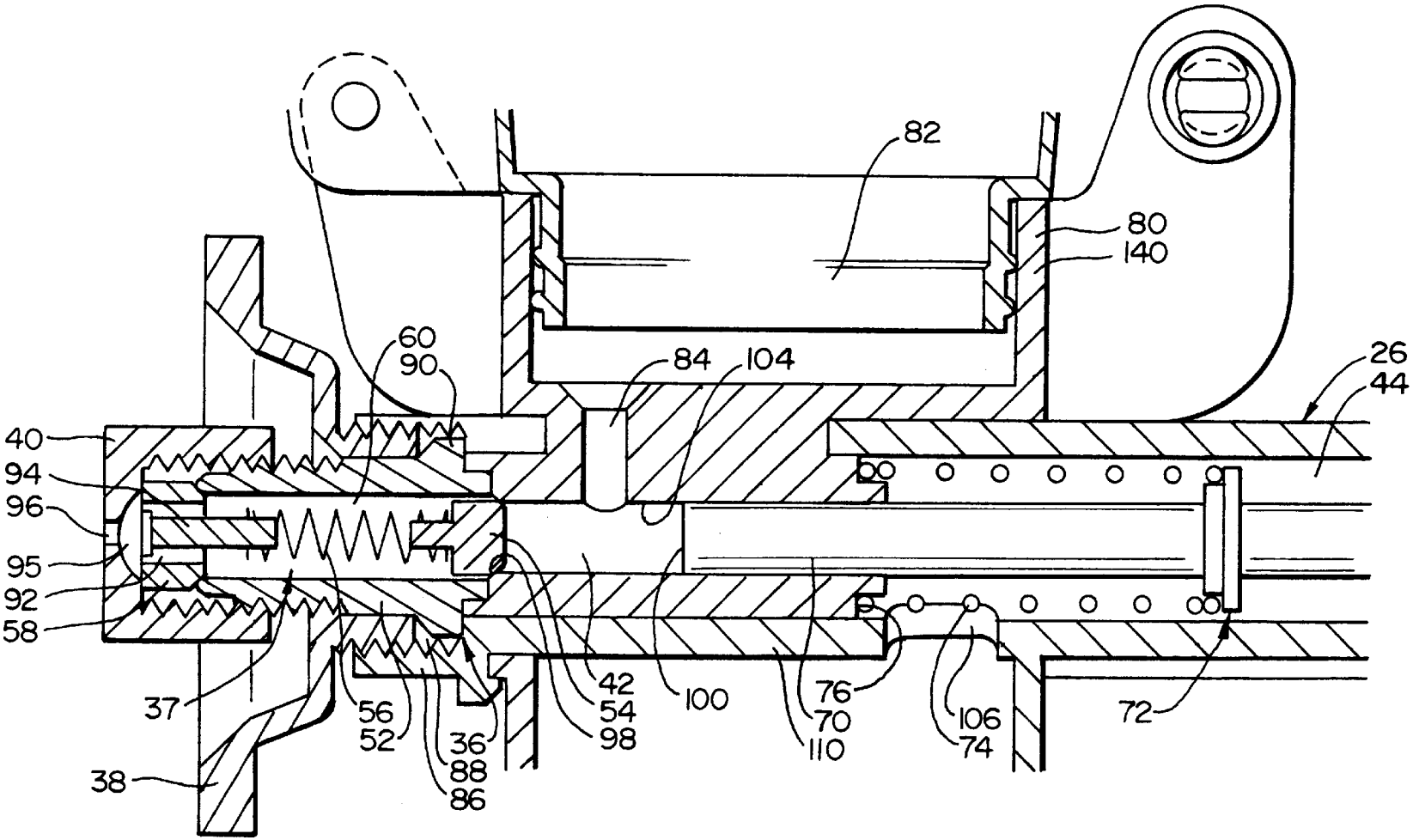
Figure 2B:
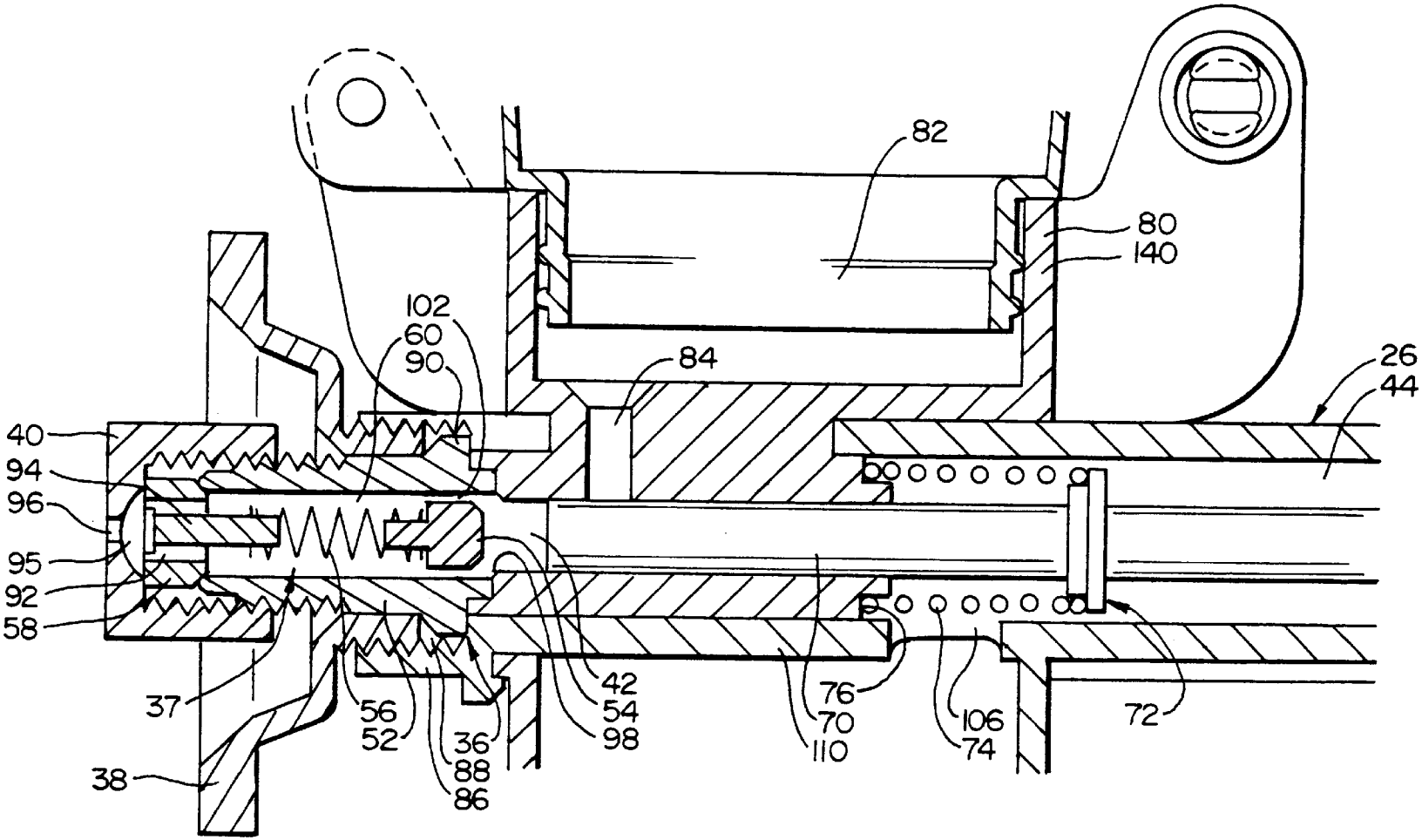

Referring now to FIGS. 1B and 2B, this process will be described in further detail. As shown in these Figures, the main housing assembly 26 is further comprised of an attachment portion 80. The attachment portion 80 allows a neck portion 82 of the hopper 24 to be connected to the gun assembly 22 such that texture material flows from the hopper 24 through an inlet port 84 and into the charging chamber 42.

An outlet portion 86 of the main housing assembly 26 is internally threaded and defines a connecting chamber 88. The spring housing member 52 has an increased diameter portion 90 that is inserted into the connecting chamber 88. The retaining member 38 has an externally threaded surface that mates with the internal threads on the outlet portion 86. When the retaining member 38 is attached to the outlet portion 86, the retaining member 38 holds the outlet spring member 52 against the main housing assembly 26 such that the outlet chamber 60 is aligned with the charging chamber 42.

The outlet member 58 defines through-holes 92 and comprises a spring post 94. The outer surface of the spring housing member 52 is externally threaded, and the nozzle member 40 is internally threaded to match the threading on the outside of the spring housing member 52. The nozzle member 40 is threaded onto the spring housing member 52 with the outlet member 58 therebetween such that the through-holes 92 allow fluid communication between the outlet chamber 60 and a nozzle chamber 95 defined between the nozzle member 40 and outlet member 58. An outlet orifice 96 is formed in the nozzle member 40 such that fluid may pass between the nozzle chamber 95 and the exterior of the gun assembly 22.

Additionally, one end of the spring 56 is held by the spring post 94 and the other end of the spring 56 is attached to the check valve member 54 such that the check valve member 54 is within the outlet chamber 60 and normally held against an annular surface 98 formed on the main housing assembly 26.

A disc-like working surface 100 is formed on the head 70 of the piston 28. This working surface 100 acts on material within the charging chamber 42 when the piston 28 moves from its charging position to its expelling position. The surface area of this working surface 100 is approximately 0.80 $in^2$ in the preferred embodiment, should be within a first preferred range of between 0.5 to 1.0 $in^2$, but in any event should be at least 0.03 $in^2$.

As shown by comparing FIGS. 1B and 2B, movement of the piston 28 from its charging position to its expel position forces texture material within the charging chamber 42 against the check valve member 54. The check valve member 54 compresses the check valve spring 56, at which time the check valve member 54 is unseated from the annular surface 98 on the main housing assembly 26. This creates an annular channel around the check valve member as shown at 102 in FIG. 2B that allows texture material to flow past the check valve member 54, through the outlet chamber 60, through the through-holes 92, into the nozzle chamber 95, and out the outlet orifice 96.

When the return spring forces the piston 28 back toward its charging position, the check valve member 54 is allowed to return to its closed position in which it is seated against the annular surface 98. This closes the charging chamber 42 on all sides but through the inlet port 84. Accordingly, by action of gravity and a vacuum created by the movement of the return spring 74, texture material flows in to the charging chamber 42 to recharge this chamber with texture material for the next cycle.

From the foregoing, it can be seen that the check valve assembly 37 forms a check valve that prevents texture material from flowing out of the charging chamber 42 when the piston 28 is not travelling forward. Only when this piston 28 is travelling forward will the check valve assembly 37 open so that texture material may flow out of the outlet orifice 96.

The combination of the check valve assembly 37, retaining member 38, and outlet member 40 allows this portion of the gun assembly 22 to be disassembled for cleaning.

As can be seen in FIG. 1B, when the piston 28 is in its charged position, a substantial surface area of the head portion 70 thereof overlaps with an interior surface 104 of the main housing assembly 26 that defines the charging chamber 42. This overlap essentially forms a seal that should prevent texture material within the charging chamber 42 from being forced by back pressure into the return spring chamber 44. The gun assembly 22 thus does not employ a separate seal to seal the gap between the piston head portion 70 and the main housing assembly inner surface 104.

But with wear and certain materials having lower viscosity, it is possible that a small amount of the material being dispensed will leak into the return spring chamber 44. This leaked material cannot be recycled by gravity back into the hopper 24 because, as discussed above, the higher viscosity of the texture material requires the hopper to be mounted above the gun assembly 22. Accordingly, an overflow port 106 is formed in the main housing assembly 26 such that any material leaking into the return spring chamber 44 will drain through this overflow port 106 into the overflow chamber 50 described above. In this respect, referring for a moment again back to FIG. 1A, it can be seen that this overflow chamber 50 is defined by an inner surface 108 of the overflow housing member 34 and outer surfaces 110 and 112 of the main housing assembly 22.

The overflow housing member 34 is detachably attached to the main housing assembly 26 by an attachment system 114 comprising an upper latch 116 and a lower latch 118. The upper latch 116 comprises a latching projection 120 formed on the main housing assembly outer surface 110 and a flange 122 formed along an upper edge of the overflow housing member 34. The flange 122 is held by the projection 120 so that movement of the flange 122 relative to the projection 120 is allowed only in one direction: that is towards the main housing assembly outer surface 112.

The lower latch assembly 118 comprises a latch projection 124 and locking projection 126 that extend from the main housing assembly outer surface 112 and a vertical flange 128 formed on the overflow housing member 34. A groove or indent 130 is formed on the vertical flange 128.

In practice, the upper flange 122 is placed under the projection 120 and the overflow housing member 34 rotated (counterclockwise in FIG. 1A) until the lower flange 128 is received behind the lower projection 124 and the locking projection 126 is received in the groove or indent 130. The groove or indent 130 positively engages the locking projection 126 to form a snap fit that prevents the vertical flange 128 from inadvertently rotating out of the position shown in FIG. 1A. But a firm, positive application of manual force to rotate (clockwise in FIG. 1A) the overflow housing member 34 about a pivot defined by the upper flange 122 will cause the stop projection 126 to disengage from the groove 130 and allow the overflow housing member 34 to be detached from the main housing assembly 26. The overflow housing member 34 may thus be removed to be checked for any leakage and emptied if any leakage is discovered.

In this respect, it should be noted that an upper edge 132 of the lower, vertical flange 128 is spaced above a lowermost portion 134 of the overflow housing member inner surface 108. Texture material within the chamber 50 is thus less likely to leak as the bottom wall defining this chamber 50 is formed by a single, continuous portion of the inner surface 108.

FIG. 1A also shows a drive opening 136 that allows the drive member 64 to extend from the motor chamber 46 into the return spring chamber 44. The drive opening 136 is spaced from the overflow orifice 106 by a wall 138. The spacing of these openings 106 and 136 from each other helps prevent texture material from entering the motor chamber 46 where it might interfere with the operation of the motor assembly 30.

The overflow housing member 34 and overflow port 106 thus function to trap any texture that may leak into the return spring chamber 44, thereby preventing contamination of more critical parts. Additionally, operation of the gun assembly 22 may eventually deteriorate with time as the piston 28 and/or the inner surface 104 of the main housing assembly 26 wear. Should this wear occur, more texture material will leak from the charging chamber 42 into the return spring chamber 44 and be trapped in the overflow chamber 50. Accordingly, if the user notices over time that more and more texture material is accumulating within this chamber 50 for a given spraying time, the user will know that certain parts of the gun assembly 22 need to be replaced for optimum performance.

To facilitate the function of the overflow housing member 34, this member 34 may be made of a transparent plastic material that allows the user to see into the overflow chamber 50 and determine how much texture material has accumulated therein.

Another important aspect of the present invention is the ergonomic arrangement of the various elements of the gun assembly 22. In particular, when the hopper 24 is full of texture material, it can be quite heavy. The gun assembly 22 is designed such that the hopper 24 is located only slightly forward of the handle portion 48. In particular, the attachment portion 80 comprises a cylindrical flange 140 adapted to receive the neck 82. This cylindrical flange is spaced rearwardly relative to the inlet port 84; in other words, the inlet port is located forward of the central axis defined by the cylindrical flange 140. This shifts the weight of the hopper 24 slightly to the rear so that it is more above the handle 48.

Additionally, the piston 28 and the stroke thereof are made as short as possible so that the inlet port 84 itself may be located as close as possible to the handle portion 48.

These features allow most of the weight of the hopper 24 to be arranged almost directly above the handle portion 48 so that the hopper is not tending to cause the nose of the gun 22 to be forced downward. The user is thus not having to fight the weight of the hopper when using the gun assembly 22.

The gun assembly 22 further comprises a trigger member 142 that operates a switch that allows or prevents current from flowing to the solenoid assembly 62. As is common with hopper guns, moving the trigger member 142 to the right in FIG. 1A closes the switch and allows current to reach the solenoid assembly 62.

Referring now to FIGS. 3–5, it can be seen that the nozzle member 40 may be embodied in any one of a number of configurations. Each of these configurations is adapted to obtain a different texture pattern. The nozzle member 40 shown in FIGS. 1 and 2 has an outlet orifice 96 of one cross-sectional area, the nozzle member 40*a* shown in FIG. 3 has an outlet orifice 96*a* having a second predetermined cross-sectional area, and the nozzle member 40*b* shown in FIG. 4 has an outlet orifice 96*b* having a cross-sectional area of a third size. Each of these nozzle members 40, 40*a*, and 40*b* correspond to a different texture pattern, and one of these is selected according to the texture pattern desired.

In FIG. 5, depicted therein is yet another exemplary nozzle member 40*c*. This nozzle member 40*c* has a number of outlet orifices 144 arranged in a pattern. The particular pattern in which these orifices 144 are arranged and the cross-sectional areas of each of these orifices will affect the type of texture pattern formed by the material sprayed therethrough. It is thus possible to modify the nozzle member 40 to obtain a number of outlet orifices of a cross-sectional area as necessary to obtain a desired texture pattern.

Referring now to FIG. 6, depicted therein is a front plan view of the nozzle member 58. FIG. 6 shows that the nozzle member 58 comprises four through-holes 92 and a circular indentation 146. Texture material flowing through the through-holes 92 will recombined in this chamber 146 before being forced out of the outlet orifice 96. The outlet orifices 92 thus are configured to allow an appropriate amount of texture material to flow out of the outlet chamber 60 and into the nozzle chamber 95.

While the gun assembly 22 described above has been optimized for use as a dispenser for texture material, it should be clear that these basic principles may also be applied to other coating materials such as paint. In this case, this system may be used unmodified except that a different nozzle member 40 may be required to develop the atomizing spray required for paint materials. Other than that, the gun assembly 22 is capable of being operated as a dispenser for both paint materials and texture materials.

From the foregoing, it can be seen that the present invention does not require an external air source, thereby making it much simpler and less costly for use by nonprofessionals. But because it is operated by electrical power, the user is not required to operate a hand pump to dispense texture material. Accordingly, this gun assembly 22 may be used to apply texture material to large surfaces. This device may be used by nonprofessionals, and can be manufactured inexpensively so that it may be purchased by persons other than professionals.

It should be apparent that the present invention may be modified in forms other than that described above. Accordingly, the scope of the present invention should be determined by the claims appended hereto and not the foregoing detailed description.

What is claimed is:

1. A system for applying coating materials to a surface to be coated, comprising:

a main housing assembly defining a charging chamber into which texture material is introduced, a spring chamber, a motor chamber, an outlet chamber, and an outlet opening;

a piston having a head portion defining a working surface and a tail portion, the piston head portion being disposed partly within the charging chamber and partly within the spring chamber and the piston tail portion being disposed within the spring chamber; and a motor assembly disposed within the motor chamber for causing the piston to reciprocate between a charge position and an expel position; wherein a surface area of the working surface is at least 0.03 square inches.

2. A system as recited in claim 1, further comprising an overflow housing member attached to the main housing assembly such that texture material leaking from the charging chamber into the spring chamber flows into an overflow chamber defined at least in part by the overflow housing member.

3. A system as recited in claim 2, further comprising a hopper member defining a hopper chamber, the hopper member being detachably attached to the main housing assembly such that texture material within the hopper member is gravity fed from the hopper chamber into the charge chamber.

4. A system as recited in claim 1, further comprising a hopper member defining a hopper chamber, the hopper member being detachably attached to the main housing assembly such that texture material within the hopper member is gravity fed from the hopper chamber into the charge chamber.

5. A system as recited in claim 1, in which the surface area of the working surface is approximately 0.80 $in^2$.

6. A system as recited in claim 1, in which the housing assembly further comprises a plurality of nozzle members each defining an outlet opening of a different cross-sectional area, where one of the plurality of nozzle members is used to apply the texture material in a texture pattern to match a pre-existing texture pattern.

7. A system for applying coating materials to a surface to be coated, comprising:

a main housing assembly defining a charging chamber into which texture material is introduced, a spring chamber, a motor chamber, an outlet chamber, and an outlet opening;

a piston having a head portion defining a working surface and a tail portion, the piston head portion being disposed partly within the charging chamber and partly within the spring chamber and the piston tail portion being disposed within the spring chamber; and a motor assembly disposed within the motor chamber for causing the piston to reciprocate between a charge position and an expel position; and an overflow housing member detachably attached to the main housing assembly such that texture material leaking from the charging chamber into the spring chamber flows into an overflow chamber defined at least in part by the overflow housing member, where the overflow housing member may be detached from the main housing assembly to remove texture material from the overflow chamber.

8. A system as recited in claim 7, in which a surface area of the working surface is at least 0.03 square inches.

9. A system as recited in claim 8, in which the surface area of the working surface is approximately 0.80 square inches.

10. A system as recited in claim 8, further comprising a hopper member defining a hopper chamber, the hopper member being detachably attached to the main housing assembly such that texture material within the hopper member is gravity fed from the hopper chamber into the charge chamber.

11. A system as recited in claim 7, further comprising a hopper member defining a hopper chamber, the hopper member being detachably attached to the main housing assembly such that texture material within the hopper member is gravity fed from the hopper chamber into the charge chamber.

12. A system as recited in claim 7, in which the overflow housing member is attached to the main housing assembly such that texture material leaking from the charging chamber into the spring chamber may be selectively removed from the overflow chamber.

13. A system as recited in claim 12, in which the overflow housing member is detachably attached to the main housing assembly, where the overflow housing member is detached from the main housing assembly to allow the texture material to be removed from the overflow chamber.

14. A system for applying texture material to a surface to be coated in a desired texture pattern that matches one of a plurality of predetermined texture patterns, comprising:

a main housing assembly defining a charging chamber, a spring chamber, a motor chamber, an outlet chamber, and an outlet opening;

a piston having a head portion defining a working surface and a tail portion, the piston head portion being disposed partly within the charging chamber and partly within the spring chamber and the piston tail portion being disposed within the spring chamber;

a motor assembly disposed within the motor chamber for causing the piston to reciprocate between a charge position and an expel position;

a hopper member defining a hopper chamber, the hopper member being detachably attached to the main housing assembly such that texture material within the hopper member is gravity fed from the hopper chamber into the charge chamber; and a plurality of nozzle members each defining an outlet opening of a different cross-sectional area, where each of the plurality of nozzle members is associated with one of the plurality of pre-existing texture patterns; whereby movement of the motor assembly from the charge position to the expel position forces the texture material out of the main housing assembly through the outlet opening of a selected one of the plurality of nozzle members and onto the surface to be coated in the desired texture pattern; and movement of the motor assembly from the expel position to the charge position allows texture material to flow from the hopper chamber to the charge chamber.

15. A system as recited in claim 14, in which the surface area of the working surface is at least 0.03 square inches.

16. A system as recited in claim 15, in which a surface area of the working surface is approximately 0.80 square inches.

17. A system as recited in claim 15, further comprising an overflow housing member attached to the main housing assembly such that texture material leaking from the charging chamber into the spring chamber flows into an overflow chamber defined at least in part by the overflow housing member.

18. A system as recited in claim 14, further comprising an overflow housing member attached to the main housing assembly such that texture material leaking from the charging chamber into the spring chamber flows into an overflow chamber defined at least in part by the overflow housing member.

19. A system for applying coating materials to a surface to be coated, comprising:

a main housing assembly defining a charging chamber into which texture material is introduced, a spring chamber, a motor chamber, an outlet chamber, and an outlet opening;

a piston having a head portion defining a working surface and a tail portion, the piston head portion being disposed partly within the charging chamber and partly within the spring chamber and the piston tail portion being disposed within the spring chamber; and a motor assembly disposed within the motor chamber for causing the piston to reciprocate between a charge position and an expel position; and an overflow housing member attached to the main housing assembly such that texture material leaking from the charging chamber into the spring chamber flows into an overflow chamber defined at least in part by the overflow housing member; and a hopper member defining a hopper chamber, the hopper member being detachably attached to the main housing assembly such that texture material within the hopper member is gravity fed from the hopper chamber into the charge chamber.

20. A system as recited in claim 19, in which a surface area of the working surface is at least 0.03 square inches.

21. A system for applying coating materials to a surface to be coated, comprising:

a main housing assembly defining a charging chamber, a spring chamber, a motor chamber, an outlet chamber, and an outlet opening;

a piston having a head portion defining a working surface and a tail portion, the piston head portion being disposed partly within the charging chamber and partly within the spring chamber and the piston tail portion being disposed within the spring chamber;

a motor assembly disposed within the motor chamber for causing the piston to reciprocate between a charge position and an expel position; and a hopper member defining a hopper chamber, the hopper member being detachably attached to the main housing assembly such that texture material within the hopper member is gravity fed from the hopper chamber into the charge chamber; and an overflow housing member attached to the main housing assembly such that texture material leaking from the charging chamber into the spring chamber flows into an overflow chamber defined at least in part by the overflow housing member.

22. A system as recited in claim 21, in which the surface area of the working surface is at least 0.03 square inches.

23. A system for applying coating materials to a surface to be coated, comprising:

a main housing assembly defining a charging chamber into which texture material is introduced, a spring chamber, a motor chamber, an outlet chamber, and an outlet opening;

a piston having a head portion defining a working surface and a tail portion, the piston head portion being disposed partly within the charging chamber and partly within the spring chamber and the piston tail portion being disposed within the spring chamber; and a motor assembly disposed within the motor chamber for causing the piston to reciprocate between a charge position and an expel position; and an overflow housing member attached to the main housing assembly such that texture material leaking from the charging chamber into the spring chamber flows into an overflow chamber defined at least in part by the overflow housing member, where the overflow housing member is attached to the main housing assembly such that texture material leaking from the charging chamber into the spring chamber may be selectively removed from the overflow chamber.

24. A system as recited in claim 23, in which the overflow housing member is detachably attached to the main housing assembly, where the overflow housing member is detached from the main housing assembly to allow the texture material to be removed from the overflow chamber.

* * * * *